US006672861B2

(12) United States Patent
Lee

(10) Patent No.: US 6,672,861 B2
(45) Date of Patent: Jan. 6, 2004

(54) PIEZOELECTRIC GAS LIGHTER HAVING NOZZLE ASSEMBLY

(76) Inventor: Ki-Chul Lee, 397 Bokji-eup, Baekseok-myeon, Yangju-gun, Kyungki-go (KR)

( * ) Notice: Subject to any disclaimer, the term of this patent is extended or adjusted under 35 U.S.C. 154(b) by 19 days.

(21) Appl. No.: 09/892,691

(22) Filed: Jun. 27, 2001

(65) Prior Publication Data

US 2003/0165786 A1 Sep. 4, 2003

(30) Foreign Application Priority Data

Apr. 28, 2001 (KR) ..... 2001-22672

(51) Int. Cl.[7] ..... F23Q 7/12

(52) U.S. Cl. ..... 431/255

(58) Field of Search ..... 431/255, 153, 431/143; 239/7; 137/14; 126/262; 310/339

(56) References Cited

U.S. PATENT DOCUMENTS 3,756,767 A * 9/1973 Ishiguro ..... 431/255
3,891,381 A * 6/1975 Moriya ..... 431/255

* cited by examiner

*Primary Examiner*—Henry Bennett
*Assistant Examiner*—Sabrina Dagostino
(74) *Attorney, Agent, or Firm*—Cantor Colburn LLP

(57) ABSTRACT

A piezoelectric gas lighter in which gas is ignited by means of a spark generated by a piezoelectric device comprises a nozzle assembly including a nozzle and a nozzle cap and a lighter body. The lighter body includes a gas tank, a gas ejection lever and a piezoelectric device. The nozzle has one or more auxiliary ejection holes on the side thereof as well as a main gas ejection path so that the fuel gas flows through two paths, i.e., the main gas ejection path and the auxiliary ejection hole(s). The nozzle assembly of the present invention has a gap between the nozzle and the nozzle cap, so that a small amount of fuel gas flows through the gap to be easily ignited by a spark.

15 Claims, 7 Drawing Sheets

PIEZOELECTRIC GAS LIGHTER HAVING NOZZLE ASSEMBLY

BACKGROUND OF THE INVENTION

1. Field of the Invention

This present invention relates to a piezoelectric gas lighter having a nozzle assembly wherein the fuel gas flows through two paths, i.e., the main gas ejection path and the auxiliary gas ejection hole(s), so that the ignition action may be performed easily by a spark applied to the fuel gas flowing through the auxiliary gas ejection hole(s).

2. Description of the Related Art

A conventional ignition device of a piezoelectric gas lighter shall be explained hereinafter with reference to FIGS. 1A and 1B.

As for a piezoelectric gas lighter, a piezoelectric tip 18 of a piezoelectric device 17 generates a spark by means of an ignition switch 16 being pressed. Meanwhile, the ends of a gas ejection lever 14 are lifted upward in connection with the downward movement of the ignition switch 16. A nozzle groove 25 is held between two ends of the gas ejection lever 14, so that a nozzle flange 26 which is pushed upward by the upward movement of the two ends of the gas ejection lever 14 lifts up the nozzle 20. When the nozzle 20 is lifted upward, the gas inlet of the nozzle is opened so that the fuel gas stored in the gas tank 11 is ejected outward through the nozzle. Accordingly, the fuel gas ejected through the gas ejection hole 23 is ignited by a spark which is generated by the piezoelectric tip 18, so that the combustion action may be performed successfully. Here, the pressure of the ejected gas has to be reduced properly, because the fuel gas may fail to be ignited by the spark if the gas is ejected from the gas ejection hole 23 at an excessively high speed.

In low-priced gas lighters which can be found almost everywhere and give off stronger sparks than those of the piezoelectric gas lighters using piezoelectric devices, by means of a spark wheel and a flint, the fuel gas may be ignited without a problem even when the ejected fuel gas flows at a high pressure. However, in piezoelectric gas lighters which have piezoelectric devices for generation of sparks, much smaller sparks are given off than those of flint-type gas lighters, so that there is trouble in ignition efficiency when the fuel gas is ejected from the nozzle at a high pressure. Moreover, piezoelectric gas lighters have trouble in ignition efficiency unless an exact predetermined distance is kept between the piezoelectric tip 18 and the gas ejection hole 23 and the spark is generated by the piezoelectric tip concurrently with the ejection of gas. Therefore, it is necessary to bring down the pressure of the ejected fuel gas to a preferred level. Also, the piezoelectric tip should be kept a predetermined distance from the end of the nozzle. In addition, the spark should be generated by the piezoelectric tip concurrently with the ejection of the fuel gas.

To solve the above-identified problems of the conventional piezoelectric gas lighters, a very small-sized spring has been installed in the gas ejection hole 23 of the nozzle. As for the piezoelectric gas lighter having the small-sized spring 29 on the inner walls of the gas ejection hole, the majority of the fuel gas flows outward through the main orifice of the spring 29, while a small amount of the gas flows out from the side overture of the spring 29. When a spark generated by the piezoelectric tip is applied to the fuel gas flowing off through the side overture of the spring, ignition may be achieved.

In a result, the fuel gas may be ejected via the overture of the spring with a wide ejection area so that an exact distance between the piezoelectric tip and the end of the nozzle does not have to be kept and the spark generation does not have to be perfectly synchronized with the gas ejection.

However, if the spring is installed on the walls of the gas ejection hole of the nozzle, the following disadvantages arise: First, a much higher cost may be required for the manufacture of small springs. Secondly, the very small-sized spring needs to be installed manually in the gas ejection hole of the nozzle, which may be very troublesome. That is, it is difficult to install a spring in the nozzle by an automated machines. As a result, the installation of a spring in the nozzle requires extra work so that the overall productivity remains low.

To solve the above-mentioned problems, the applicant of the present invention has already invented and applied for a patent for "An Ignition Device of the Piezoelectric Gas Lighter" wherein the device is further equipped with a screening plate to screen off the gas pressure, as disclosed in Korean Patent Application No. 10-2000-0013064 which was filed on Mar. 15, 2000.

SUMMARY OF THE INVENTION

The present invention provides a piezoelectric gas lighter in which a piezoelectricity is generated to ignite fuel gas by a piezoelectric device in response to a movement of a switch button. The piezoelectric gas lighter comprising:

a lighter body including a gas tank, a gas ejection lever installed on a top of the gas tank for opening a gas flow path in response to the movement of the switching button; and a nozzle assembly including a nozzle which comprises a lower part inserted in the gas tank, an upper part exposed outside the gas tank, and having one or more auxiliary gas ejection holes on a side thereof, and a main gas ejection path formed through the lower part and the upper part; a nozzle cap which encloses the upper part of the nozzle; and a gap defined between the nozzle and the nozzle cap so that the fuel gas ejected from the auxiliary gas ejection holes flows through the gap.

BRIEF DESCRIPTION OF THE DRAWINGS

The above objective and advantage of the present invention will become more apparent by describing in detail a preferred embodiment thereof with reference to the attached drawings in which.

DESCRIPTION OF THE PREFERRED EMBODIMENTS

Figure 1A:
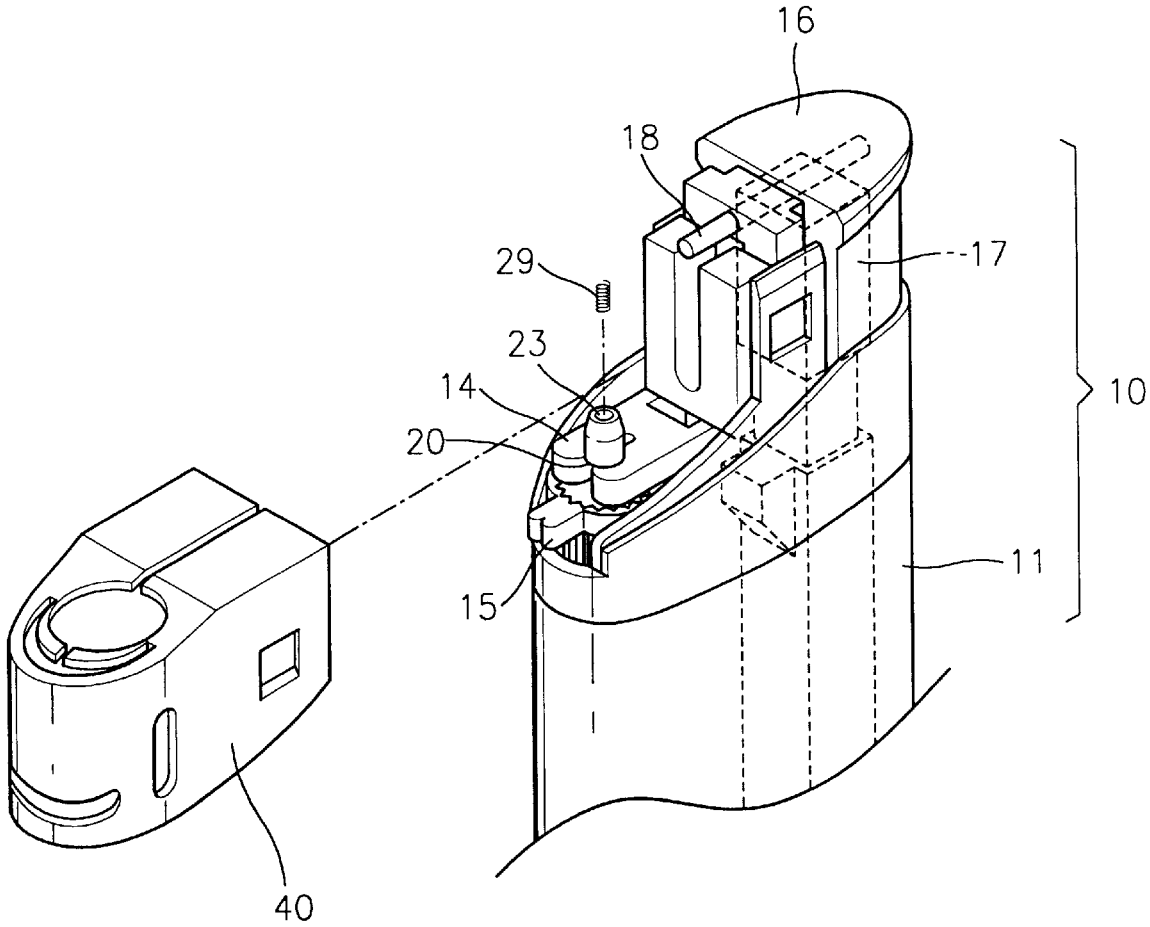
FIG. 1A (PRIOR ART)
FIG. 1A shows a perspective view of an ignition device of a conventional piezoelectric gas lighter.
Figure 1B:
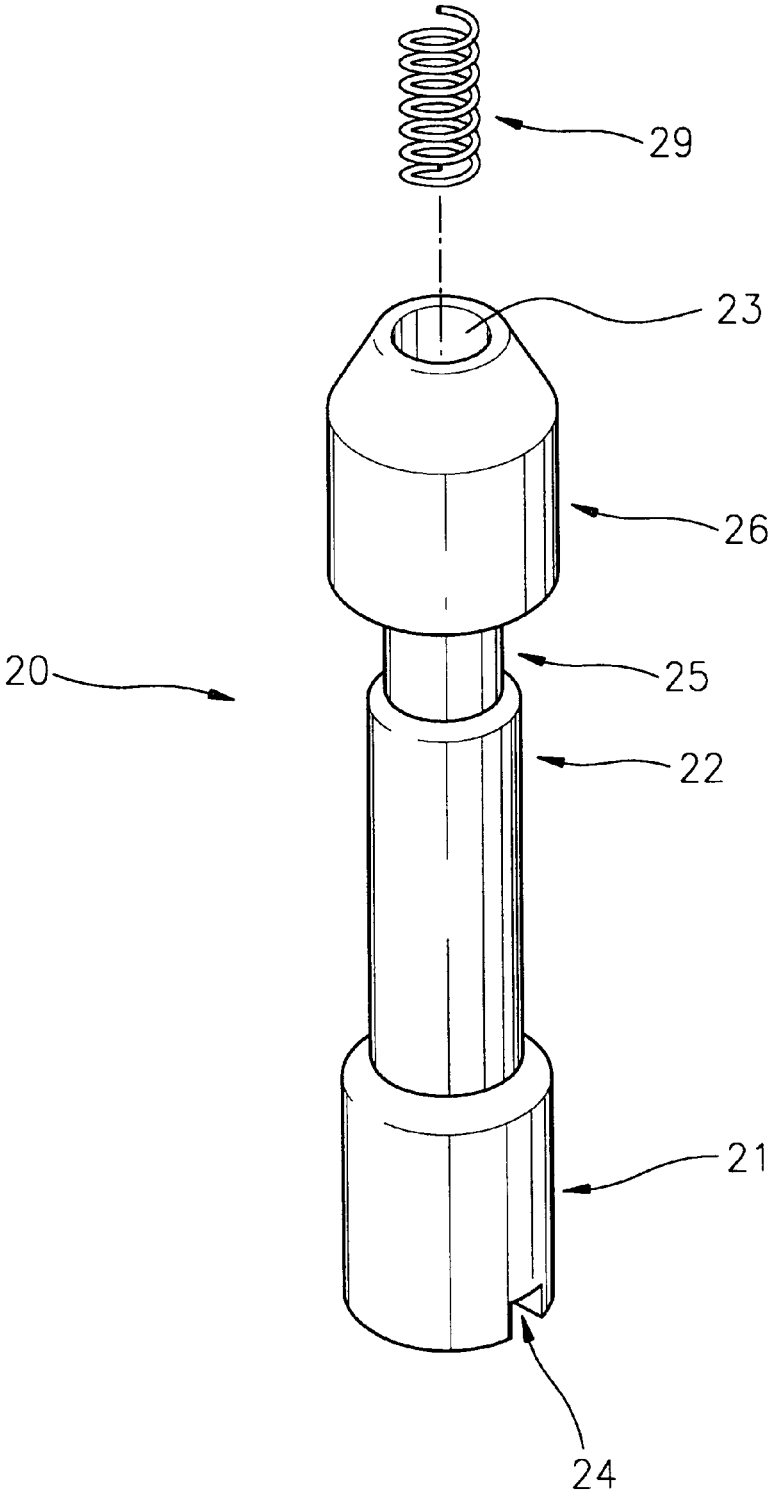
FIG. 1B (PRIOR ART)
FIG. 1B is a perspective view showing a nozzle and a spring of the conventional piezoelectric gas lighter.

The present invention provides a piezoelectric gas lighter having a nozzle assembly, which improves the ignition efficiency significantly in comparison with the prior art and reduces the manufacturing cost.

An embodiment of the piezoelectric gas lighter according to the present invention shall be explained hereinbelow with reference to FIGS. 2 through 6.

The piezoelectric gas lighter comprises a lighter body 100 and a nozzle assembly including a nozzle 200 and a nozzle cap 300. The nozzle 100 includes a gas tank 110, a gas ejection lever 140 installed on top of the gas tank for opening a gas flow path in response to the movement of the switch button. The nozzle 200 has a low part 210 inserted in the gas tank, an upper part 220 exposed outside the gas tank, and having one or more auxiliary gas ejection holes 280 on a side thereof, a main gas ejection path 230 formed through the lower part 210 and the upper part 220. The nozzle cap 300 encloses the upper part 220 of the nozzle 200. A gap 290 is defined between the nozzle 200 and the nozzle cap 300 so that the fuel gas ejected from the auxiliary gas ejection holes 280 flows through the gap 290.

Figure 3A:
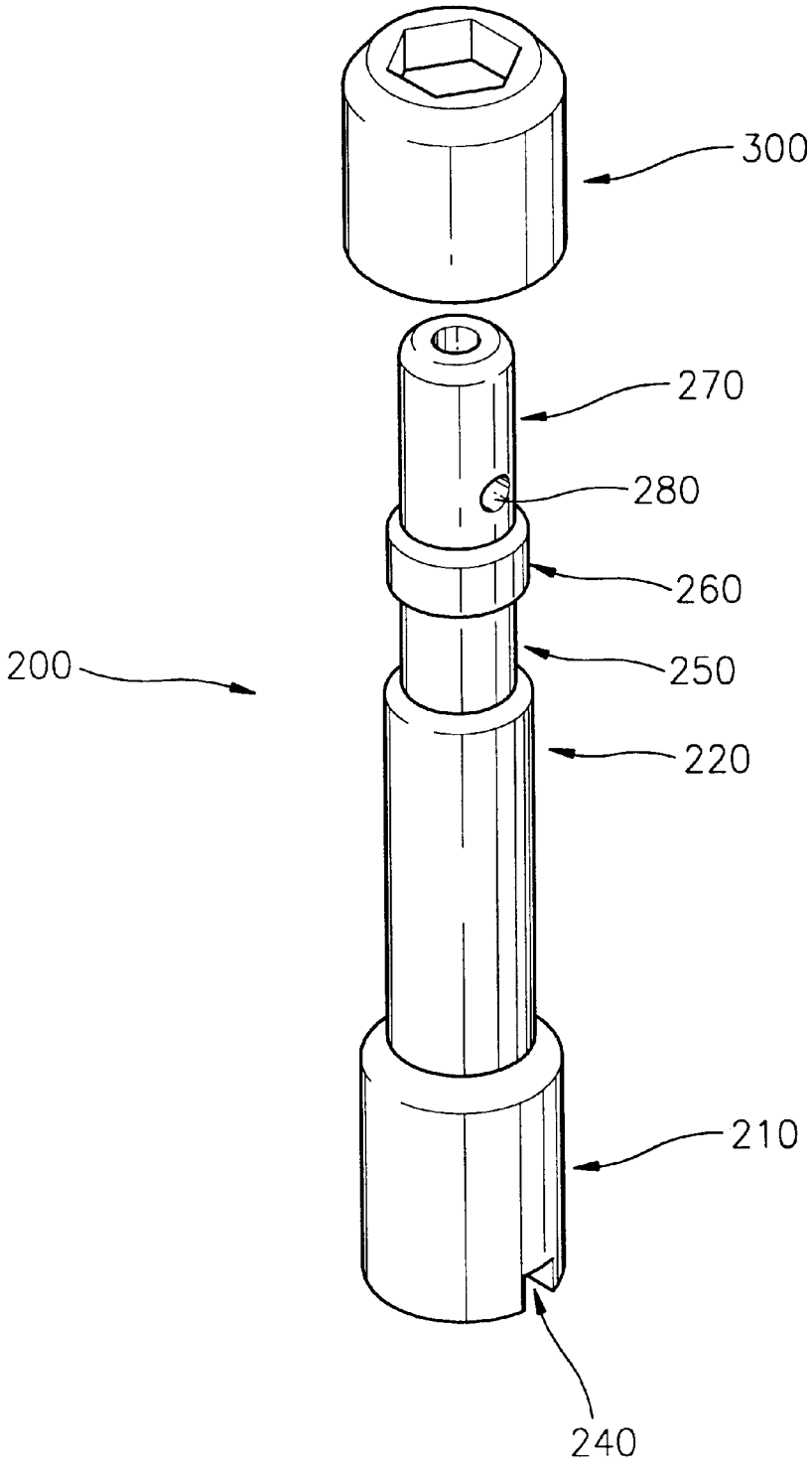
FIG. 3A is a perspective view showing a nozzle and a nozzle cap, which are not combined, of the nozzle assembly according to the present invention.
Figure 6:
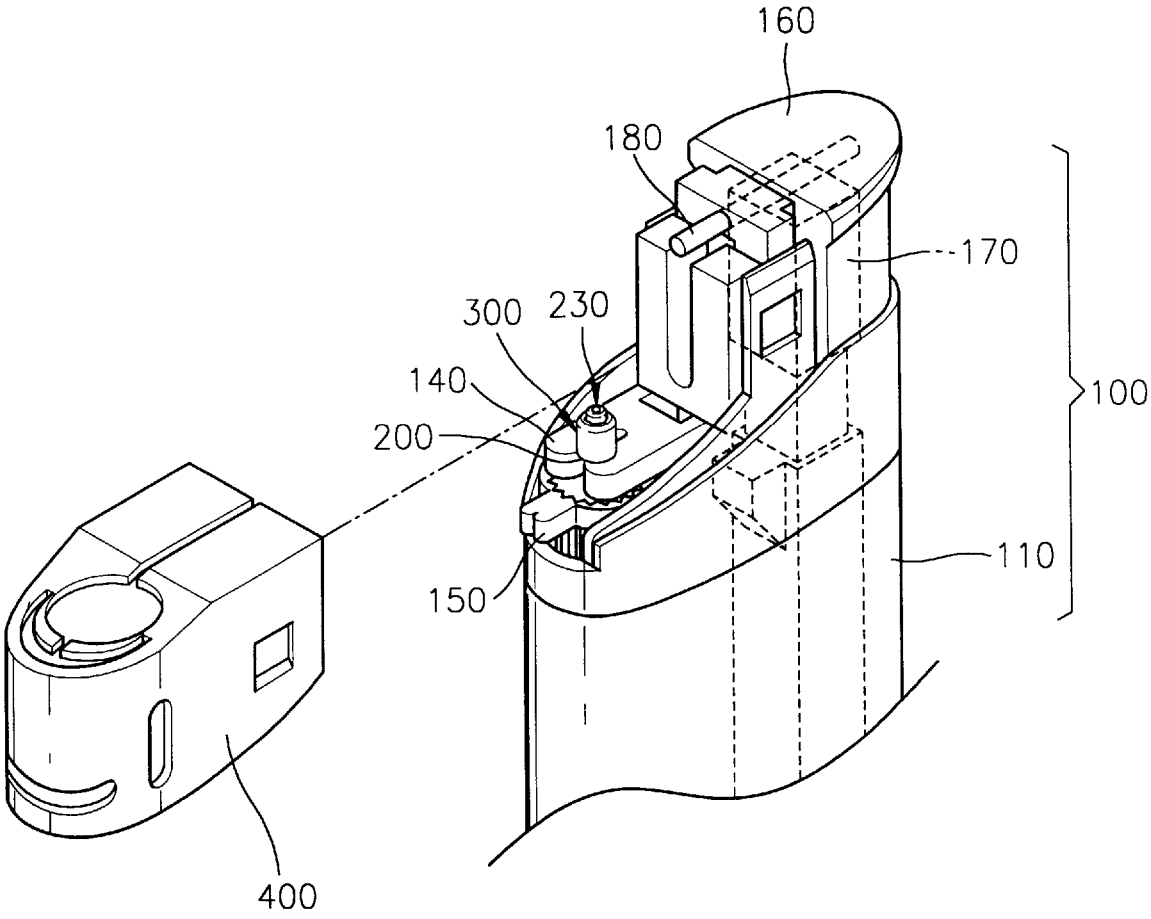
FIG. 6 shows a perspective view of the piezoelectric gas lighter having the nozzle assembly according to the present invention.

The ignition device of the piezoelectric gas lighter incorporating the nozzle assembly according to the present invention is illustrated in FIG. 6. With reference to FIGS. 3A and 6, the nozzle of the piezoelectric gas lighter may be defined as two parts, i.e., a lower part 210 and an upper part 220. The lower part of the nozzle is fixed inside the gas tank through a nozzle housing. The nozzle housing includes the gas ejection lever 140 and a gas volume control lever 150 therein.

The upper part of the nozzle is exposed outside the gas tank. A nozzle groove 250 and a nozzle flange 260 are formed on the circumference of the upper part 220 of the nozzle, so that two ends of the gas ejection lever 140 are held in the nozzle groove. When the user presses an ignition switch 160, the ends of the gas ejection lever 140 go upward in connection with the downward movement of the ignition switch. The two ends of the gas ejection lever 140 lift the nozzle flange 260 upward so that the nozzle is lifted. When the nozzle is lifted upward, the gas inlet 240 formed on the lower part 210 of the nozzle opens so that the fuel gas in the gas tank is ejected through the main gas ejection path 230 and the auxiliary gas ejection hole 280 of the nozzle.

The inner diameter of the nozzle 200 does not vary much in the lower part. On the other hand, the upper part 220 of the nozzle has a narrower inner diameter than that of the halfway part of the nozzle. That is, the sectional area of the orifice gradually becomes narrower from the lower part 210 toward the nozzle head 270, so that the pressure loss of the compressed fuel gas in the gas tank can be maintained to a small value. The compressed fuel gas is ejected at a very high speed through the main gas ejection path 230 of the nozzle.

The bottom of the lower part of the nozzle 210 is cut open to form the slot-type gas inlet 240. The gas inlet 240 extends upward from the nozzle bottom to a right angle jut, so that a thin cubic aperture is formed inside the lower part of the nozzle. By the right angle jut, the thin cubic aperture is connected to the orifice.

Figure 2:
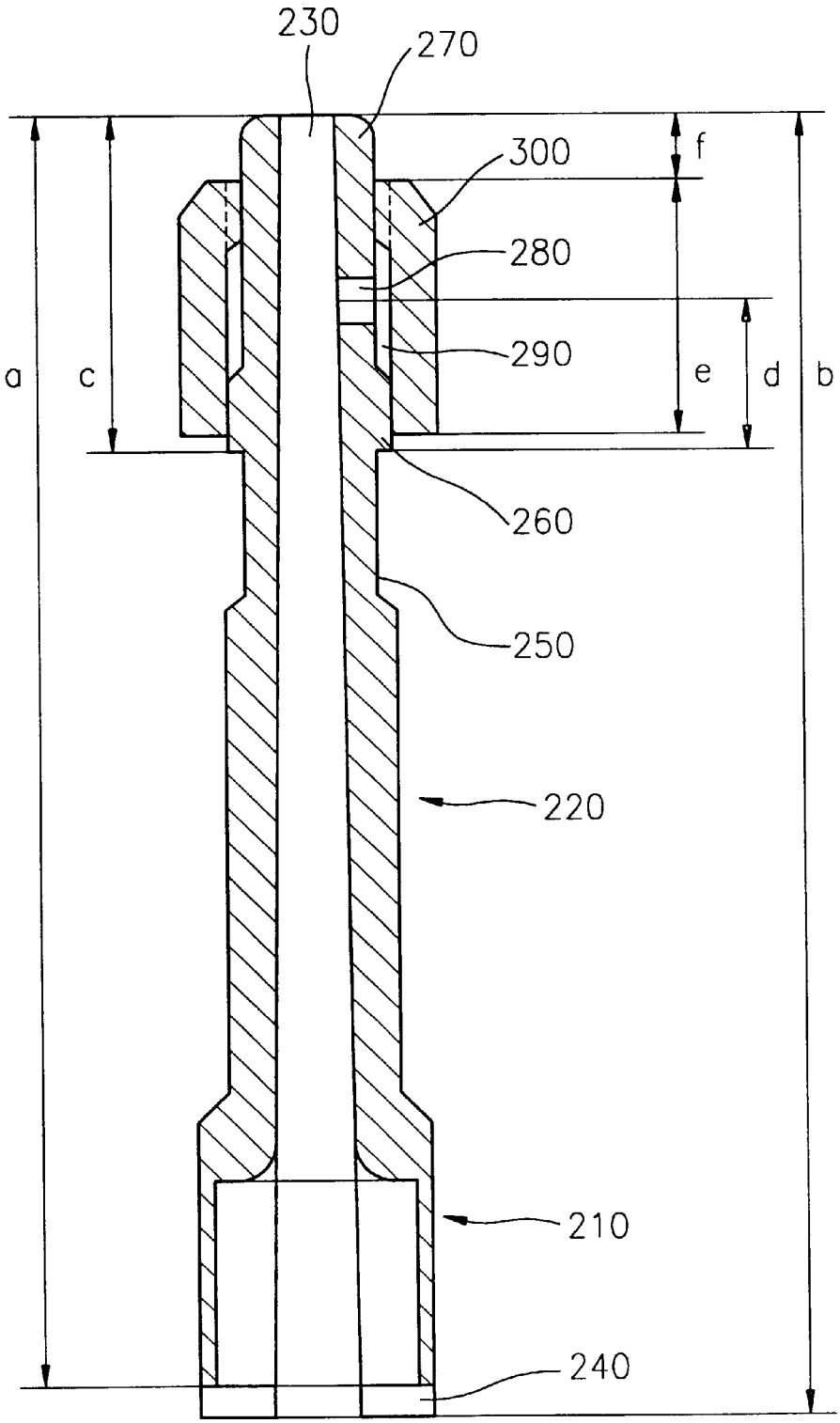
FIG. 2 shows a cross-sectional view of a nozzle assembly of a piezoelectric gas lighter according to the present invention.

As shown in FIG. 2, which shows a vertical cross sectional view of the nozzle 200, the slot-type gas inlet 240 (which is not hatched) meets with the main gas ejection path 230, which has a circular tube shape, at the right angle jut. In FIG. 2, the right angle jut is drawn with a solid line.

In an embodiment according to the present invention, the slot-type gas inlet is illustrated. However, the gas inlet may be designed to have various shapes differing from that of this embodiment.

The nozzle head 270 above the nozzle flange 260 extends to a predetermined length. The outer diameter of the nozzle head 270 is narrower than that of the nozzle flange, and the edges of the nozzle head 270 are finished off by tapering.

The one or more auxiliary gas ejection holes 280 in the nozzle head 270 have a predetermined size. Although one auxiliary gas ejection hole 280 is provided in this embodiment, a plurality of auxiliary gas ejection holes 280 may be formed in other embodiments. Also, the size of the auxiliary gas ejection holes 280 may be varied.

The nozzle of the piezoelectric gas lighter is primarily made of brass, but it may be made of zinc. The nozzle is mainly made by a die-casting method, but it may be shaped by a bit tool grinder.

The nozzle cap 300 is shaped like a thimble having a central vertical penetration. The inner walls of the nozzle cap 300 are tightly coupled with the nozzle flange 260. Most of the fuel gas ejected from the gas tank 110 flows through the main gas ejection path 230. However, a small amount of gas is ejected from the auxiliary gas ejection hole 280 so that it flows outward via the gap 290 defined between the circumferential surface of the nozzle head 270 and the inner walls of the nozzle cap 300.

A lower part of the nozzle cap 300, which faces the gas tank when the nozzle cap 300 is coupled with the nozzle 200, is made to have an inner diameter which is identical with the outer diameter of the nozzle flange 260, so that the nozzle cap 300 is tightly coupled with the nozzle flange 260. In this embodiment, the upper part of the nozzle cap 300, which encloses the nozzle head 270 by a predetermined gap 290, is made to have an inner diameter which is narrower than that of the lower part of the nozzle cap, so that the inner walls of the upper part of the nozzle cap 300 contact the circumferential surface of the nozzle head 270. Alternatively, the inner diameter of the upper part of the nozzle cap 300 may be identical with that of the lower part of the nozzle cap, so that there is a uniform gap between the nozzle cap 300 and the nozzle head 270 in the vertical direction.

The inner walls of the upper part of the nozzle cap 300 may be shaped like a cylindrical tube. Also, the inner walls of the upper part of the nozzle cap may have a polygonal shape such as a rectangle, a pentagon, a hexagon, etc.

Figure 3B:
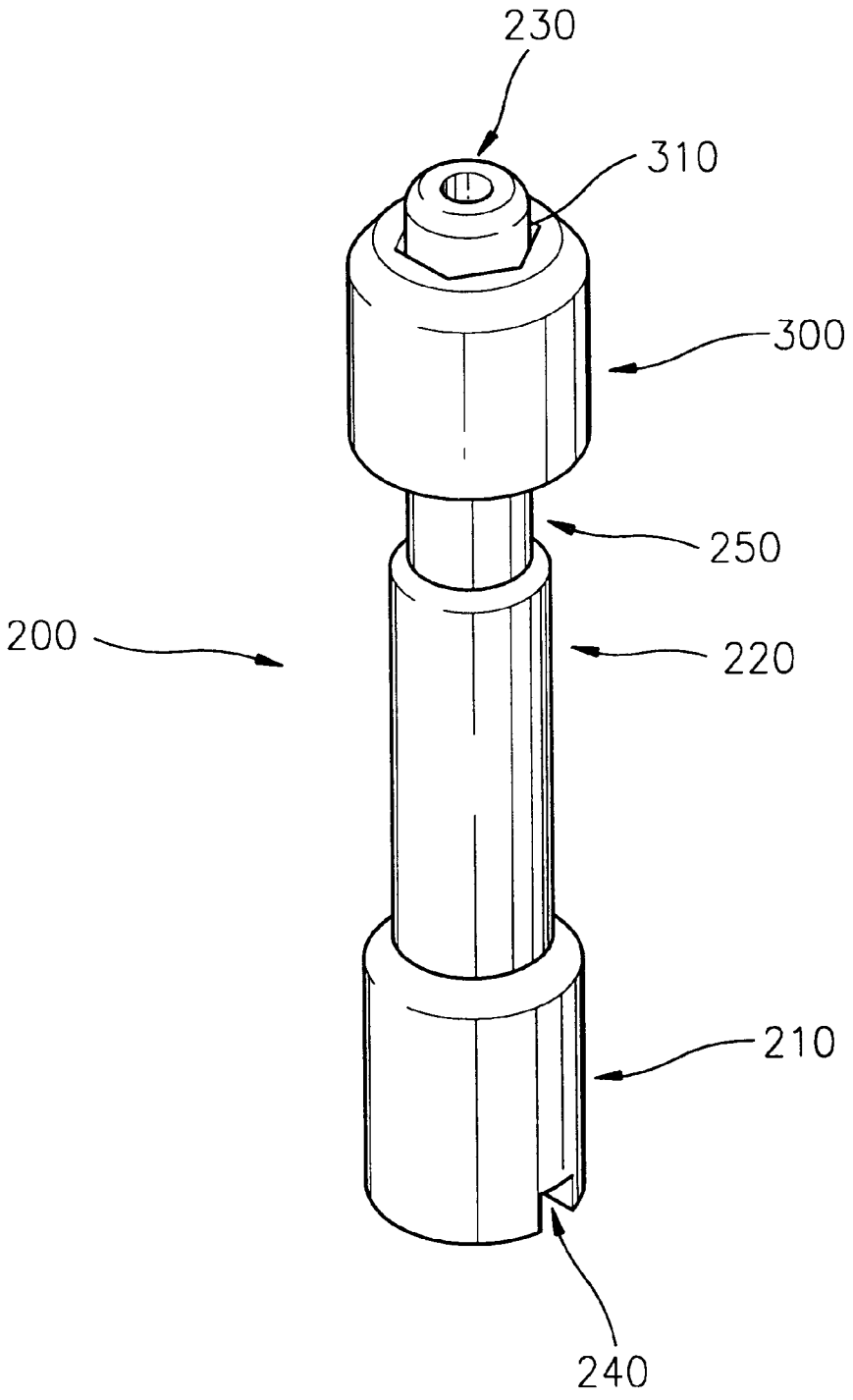
FIG. 3B is a perspective view showing a nozzle and a nozzle cap, which are combined, of the nozzle assembly according to the present invention.
Figure 5:
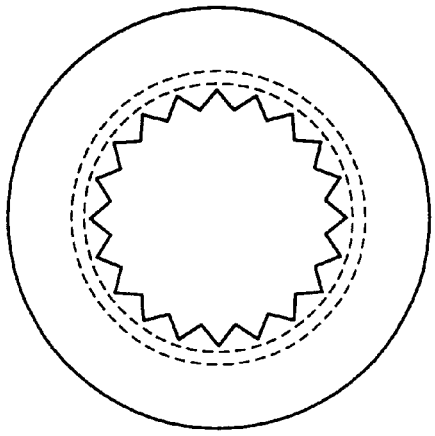
FIG. 5 shows a plane figure of the nozzle cap according to the present invention.

In FIGS. 3A and 3B showing one embodiment of the present invention, the inner walls of the upper part of the nozzle cap 300 have a hexagonal shape. Moreover, FIG. 5 shows a sawtoothed form of the inner walls of the upper part of the nozzle cap 300.

If the inner walls of the upper part of the nozzle cap have a polygonal shape, a plurality of peripheral gas ejection apertures 310 are formed by the contacting and non-contacting points. The fuel gas which is ejected from the auxiliary gas ejection hole 280 of the nozzle flows outward via the peripheral gas ejection apertures 310 so that it may be ignited by the spark generated from the piezoelectric tip 180.

The nozzle cap 300 may be made from synthetic resins or metals such as zinc.

Figure 4:
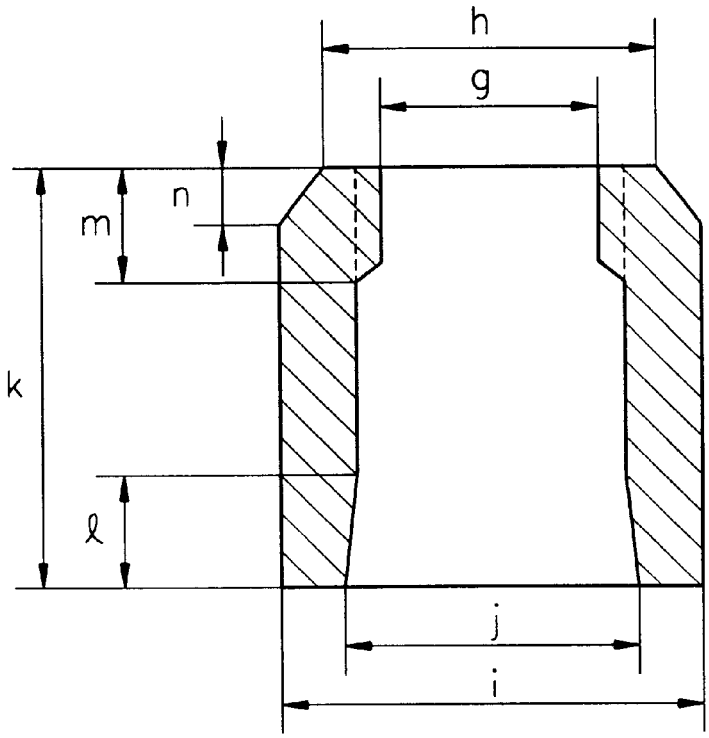
FIG. 4 shows a cross-sectional view of the nozzle cap according to the present invention.

The nozzle assembly, which is suggested in one embodiment of the present invention and shown in FIGS. 2 and 4, has the following dimensions:

| symbol | size(mm) |
|---|---|
| a | 15.5 |
| b | 16 |
| c | 4 |
| d | 1.7 |
| e | 3 |
| f | 0.8 |
| g | 1.5 |
| h | 1.8 |
| i | 3 |
| j | 2 |
| k | 3 |
| l | 0.6 |
| m | 0.8 |
| n | 0.4 |

As a preferred embodiment, the gap between the nozzle head 270 and the inner walls of the nozzle cap 300 is about 0.15 mm except the portion where the nozzle cap 300 is coupled with the nozzle flange 260. The gas from the auxiliary gas ejection hole 280 flows outward via this gap and the peripheral gas ejection apertures 310.

The gas from the main gas ejection hole of the nozzle is ejected at a very high pressure, so that it is difficult to be ignited directly by the spark generated from the piezoelectric tip 180. The ignition may fail if an exact distance is not kept between the piezoelectric tip 180 and the end of the nozzle 200 or the spark is not generated from the piezoelectric tip 180 concurrently with the ejection of gas from the nozzle 200. However, the small amount of gas, which is ejected from the auxiliary gas ejection hole 280 and flows outward via the gap and the peripheral gas ejection apertures 310, does not flow at a high speed, so that it may be ignited easily in the vicinity of the peripheral gas ejection apertures 310 by the spark generated from the piezoelectric tip 180. Also, the gas is ejected with a wide ejection area including the main gas ejection path 230 and the peripheral gas ejection apertures 310 so as to be ignited easily even when the piezoelectric tip 180 is not kept at a predetermined distance from the end of nozzle 200. In addition, the gas may be easily ignited even when a minor time gap exists between the spark generation from the piezoelectric tip 180 and gas ejection from the nozzle 200.

The piezoelectric gas lighter of the present invention has excellent ignition efficiency and a simply constructed mechanism, which makes it possible to be produced at low cost.

When a piezoelectric gas lighter incorporating a nozzle assembly according to the present invention is compared with a conventional piezoelectric gas lighter having a small spring in the nozzle, it is easily seen that the former exhibits higher ignition efficiency.

The method for installing a small spring in a nozzle has some disadvantages, in that the manufacture of the spring results in high cost and that the automatization of this process may not be appropriate. On the other hand, the nozzle assembly according to the present invention has some advantages, in that the nozzle cap may be manufactured at a much lower cost than the spring, and that coupling of the nozzle cap and the nozzle may be performed by an automatized process, so as to result in low manufacturing cost.

Although particular preferred embodiments of the present invention have been described in detail in the above for illustrative purposes, it will be recognized that variations or modifications of the piezoelectric gas lighter of the present invention described in the above, including the rearrangement of its parts, lie within the scope of the present invention.

What is claimed is:

1. A piezoelectric gas lighter in which piezoelectricity is generated to ignite fuel gas by a piezoelectric device in response to a movement of a switch button, the piezoelectric gas lighter comprising:

a lighter body including a gas tank, a gas ejection lever installed on a top of the gas tank for opening a gas flow path in response to the movement of the switching button; and a nozzle assembly including a nozzle which comprises a lower part inserted in the gas tank, an upper part exposed outside the gas tank, and having one or more auxiliary gas ejection holes on a side thereof, and a main gas ejection path formed through the lower part and the upper part; a nozzle cap which encloses the upper part of the nozzle; and a gap defined between the nozzle and the nozzle cap so that the fuel gas ejected from the auxiliary gas ejection holes flows through the gap.

2. The piezoelectric gas lighter as claimed in claim 1, wherein the lower part of the comprises a gas inlet, the upper part of the nozzle comprises a nozzle groove having a predetermined depth on an outer surface thereof, a nozzle flange placed above the nozzle groove and having a larger diameter than that of the nozzle groove, and a nozzle head having a smaller diameter than that of the nozzle flange and protruding to a predetermined length.

3. The piezoelectric gas lighter as claimed in claim 1, wherein the nozzle cap comprises an inner wall, a portion of which contacts an outer surface of the nozzle, and the gap is defined by the outer surface of the nozzle and the inner wall of the nozzle cap contacting the outer surface of the nozzle.

4. The piezoelectric gas lighter as claimed in claim 3, wherein the inner wall of the nozzle cap is polygon shaped.

5. The piezoelectric gas lighter as claimed in claim 4, wherein a plurality of peripheral gas ejection pathways is formed by contacting and non-contacting points between the outer surface of the nozzle and the inner wall of the nozzle cap.

6. The piezoelectric gas lighter as claimed in claim 3, wherein the inner wall of the nozzle cap is sawtooth shaped.

7. The piezoelectric gas lighter as claimed in claim 6, wherein a plurality of peripheral gas ejection pathways is formed by contacting and non-contacting points between the outer surface of the nozzle and the inner wall of the nozzle cap.

8. The piezoelectric gas lighter as claimed in claim 2, wherein the nozzle cap comprises an inner wall, a portion of which contacts an outer surface of the nozzle flange, and the gap is defined by the outer surface of the nozzle head and the inner wall of the nozzle cap contacting the outer surface of the nozzle flange.

9. The piezoelectric gas lighter as claimed in claim 8, wherein the inner wall of the nozzle cap is polygon shaped.

10. The piezoelectric gas lighter as claimed in claim 9, wherein a plurality of peripheral gas ejection pathways is formed by contacting and non-contacting points between the outer surface of the nozzle head and the inner wall of the nozzle cap.

11. The piezoelectric gas lighter as claimed in claim 8, wherein the inner wall of the nozzle cap is sawtooth shaped.

12. The piezoelectric gas lighter as claimed in claim 11, wherein a plurality of peripheral gas ejection pathways is formed by contacting and non-contacting points between the outer surface of the nozzle head and the inner wall of the nozzle cap.

13. The piezoelectric gas lighter as claimed in claim 2, wherein the one or more auxiliary gas ejection holes are formed in the nozzle head.

14. The piezoelectric gas lighter as claimed in claim 1, wherein the nozzle cap surrounds the one or more auxiliary gas ejection holes with the gap between the nozzle cap and the nozzle.

15. The piezoelectric gas lighter as claimed in claim 2, wherein the nozzle head comprises a top end protruding above the nozzle cap.

* * * * *